US006375518B2

(12) United States Patent
Sato

(10) Patent No.: US 6,375,518 B2
(45) Date of Patent: Apr. 23, 2002

(54) CONNECTING METHOD OF CONNECTORS

(75) Inventor: Kei Sato, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/725,816

(22) Filed: Nov. 30, 2000

(30) Foreign Application Priority Data

Dec. 2, 1999 (JP) ..... 11-343664

(51) Int. Cl.[7] ..... H01R 13/502
(52) U.S. Cl. ..... 439/701; 439/884; 29/844
(58) Field of Search ..... 439/701, 884–885, 439/904, 888, 889–906, 907; 29/882, 844, 845, 884

(56) References Cited

U.S. PATENT DOCUMENTS 3,663,931 A * 5/1972 Brown ..... 439/75
3,955,877 A * 5/1976 Cobaugh et al. ..... 439/853
4,965,933 A * 10/1990 Mraz et al. ..... 29/882
5,108,305 A * 4/1992 Suzuki ..... 439/488
5,417,589 A * 5/1995 Terada ..... 439/590
5,707,260 A * 1/1998 Yanase ..... 439/885
5,749,752 A * 5/1998 Kashiyama et al. ..... 439/733.1
6,017,224 A * 1/2000 Yanagida ..... 439/80
6,161,283 A * 12/2000 Tokuwa ..... 29/882

OTHER PUBLICATIONS

U.S. application No. 09/438,769, filed Nov. 12, 1999.

* cited by examiner

*Primary Examiner*—Tulsidas Patel
(74) *Attorney, Agent, or Firm*—Finnegan, Henderson, Farabow, Garrett, & Dunner, L.L.P.

(57) ABSTRACT

A first connector is accommodated in a connector housing, with a first connection member lying down relative to the first terminal. The first connection member is raised relative to the first terminal. The first connector and a second connector are stacked to be connected each other.

10 Claims, 10 Drawing Sheets

CONNECTING METHOD OF CONNECTORS

BACKGROUND OF THE INVENTION

The present invention relates to a connecting method of connectors and more specifically to a connecting method of stacked connectors.

As this type of connecting method of connectors, there is a method in which a plurality of insulation displacing joint terminals are accommodated in a connector housing, the connector housings are stacked vertically, and the upper and lower connector housings are connected to each other through connections between the predetermined terminals.

First, a group body of a multiple insulation displacing joint terminals is prepared, the group body including the multiple insulation displacing joint terminals with their longitudinal one side ends being integrally formed with the other side edge of a carrier at predetermined intervals. In the terminal, side plates on opposite sides in a transverse direction are bent to face each other and a tab for connection bent to be folded back diagonally upward from a lower part of longitudinal the other side end of the terminal is provided. A part to be connected is formed under the tab. A tab of another terminal disposed under the terminal can be inserted into and connected to the part.

SUMMARY OF THE INVENTION

However, according to the above relevant-art connecting method of the connectors, if the terminal group body is shipped in a state in which the terminal group body is wound around the reel, for example, and if the tabs are in vertically raised states, the tabs may be deformed due to arranging in a step of mounting wire harnesses or in a transferring step. Therefore, it is necessary to make sure again that the tabs are in raised states and to correct the raised states of the tabs in stacking the connectors.

In the above method, since the tabs that are once raised in a press step are laid down if necessary in the step of mounting the wire harnesses, the number of manufacturing processes increases. Moreover, since a part of the tab bent in the raising step is bent again in the laying down step, a crack or the like may generate in the bent part and strength reduces.

It is an object of the present invention to provide a connecting method of connectors by which the number of manufacturing processes can be reduced and strength of the tabs can be increased.

To achieve the object, an aspect of the invention provides a connecting method of connectors comprising the following steps. A first connector is accommodated in a connector housing, with a first connection member lying down relative to the first terminal. The first connection member is raised relative to the first terminal. The first connector and a second connector are stacked to be connected each other.

Preferably, the first connection member lying down is at substantially a right angle to a stacking direction of the first connector and the second connector.

Preferably, the first terminal includes side plates extending from a bottom plate and opposing each other, and the first connection member extends upward from the bottom plate and is bent at a first position in parallel with the bottom plate.

Preferably, the first connection member to be raised is bent at a second position different from the first position.

Preferably, the second connector accommodating a second terminal including a part to be connected for connecting with the first connection member and the second connection member each other and the first connector are stacked each other, and the first connection member raised from the first connector is inserted in the second connector to connect with the part to be connected with of the second terminal.

According to the invention, since the first connection member are not raised, the first connection member is less likely to be deformed in transferring the first terminal. Since the first connection member is raised with the first terminal being accommodated in the connector housing, the interval between the raising of the first connection member and the stacking and connecting of the connectors can be shortened, thereby reducing the possibility of deformation of the first connection member and ensuring the connection. Since it is unnecessary to raise the first connection member in advance, the number of manufacturing processes required to connect the connectors can be reduced.

Since the first connection member are lying in a direction substantially normal to a stacking direction of the connectors before raising the first connection member, winding and arranging of the terminals are facilitated when multiple terminals are formed continuously, for example.

Since the first connection member can be bent to be accommodated between the side plates, the first connection member is protected by the side plates and deformation of the first connection member can be suppressed.

Since the first connection member is bent for the first time in the second position in which the first connection member is raised, a possibility of generation of damage such as a crack in the bent base part of the first connection member can be reduced and strength of the first connection member can be increased.

BRIEF DESCRIPTION OF THE ACCOMPANYING DRAWINGS

DETAILED DESCRIPTION OF THE PREFERRED EMBODIMENT

Figure 1:
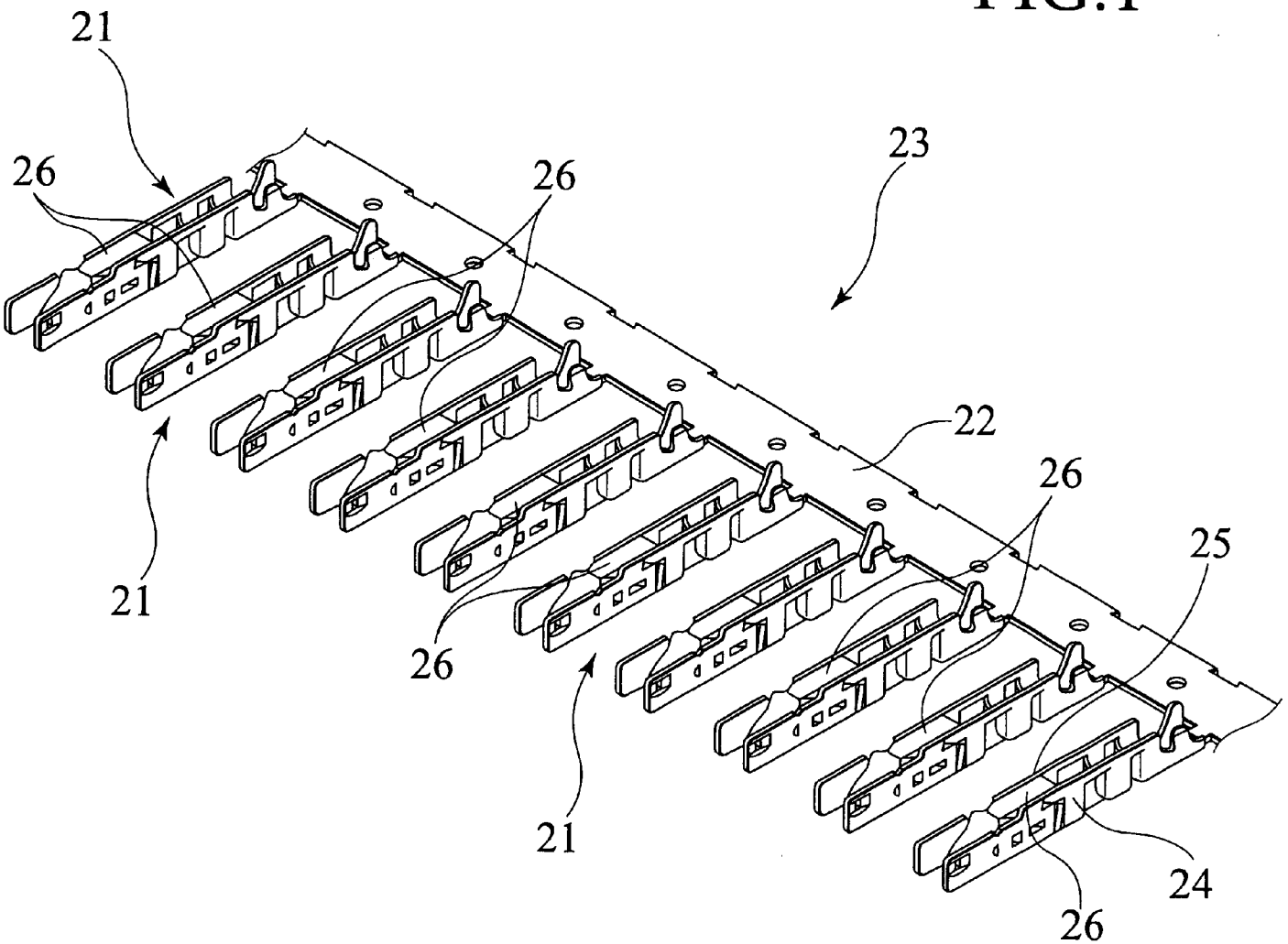
FIG. 1 is a perspective view showing a group body of a multiple insulation displacing joint terminals used in an embodiment of a connecting method of connectors according to the present invention.

Details of a connecting method of connectors according to the present invention will be described below based on an embodiment shown in the drawings.

As shown in FIG. 1, a group body 23 of a multiple insulation displacing joint terminals is prepared, the group body 23 including the multiple insulation displacing joint terminals 21 with their longitudinal one side ends being integrally formed with the other side edge of a carrier 22 at predetermined intervals. Side plates 24 and 25 on opposite sides in a transverse direction of the terminal 21 are bent to face each other. The terminal 21 has a tab 26 for connection, or a first connection member, bent to be folded back diagonally upward from a lower part of longitudinal the other side end of the terminal 21 and extending toward the one side end side of the terminal 21. A part 21A to be connected that will be described later is formed under the tab 26. A tab 26 of another terminal 21 disposed and placed under the terminal 21 can be inserted into and connected to the part 21A.

Then, such a terminal group body 23 is subjected to a press step such that spacings between respective adjacent terminals 21 are reduced. In other words, as shown in FIG. 2, presswork is applied to corrugate the carrier 22 such that the spacings are reduced and that the terminal group body 23 can be accommodated in a connector housing 27.

Figure 2:
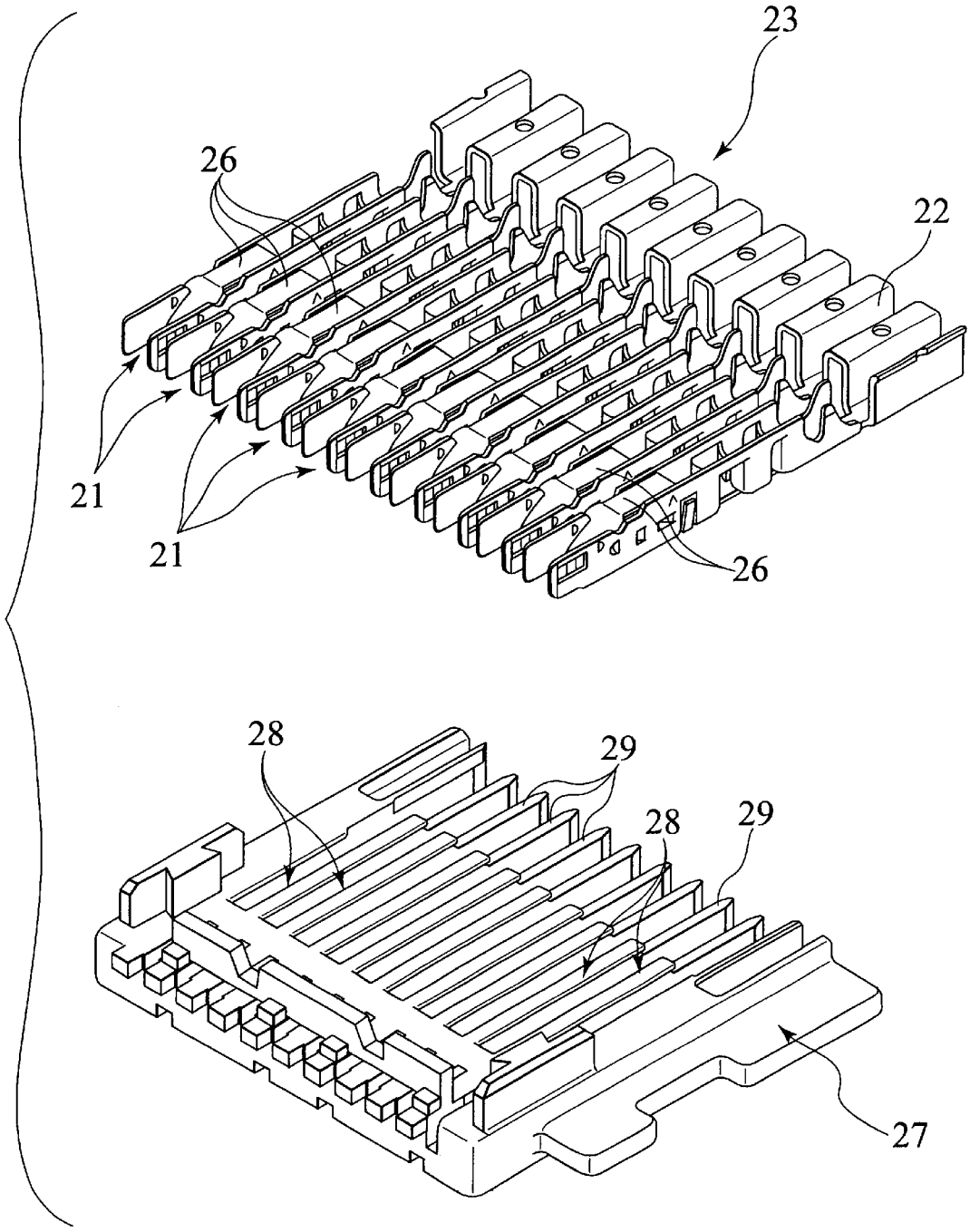
FIG. 2 is a perspective view showing an assembly step in the embodiment.
Figure 3:
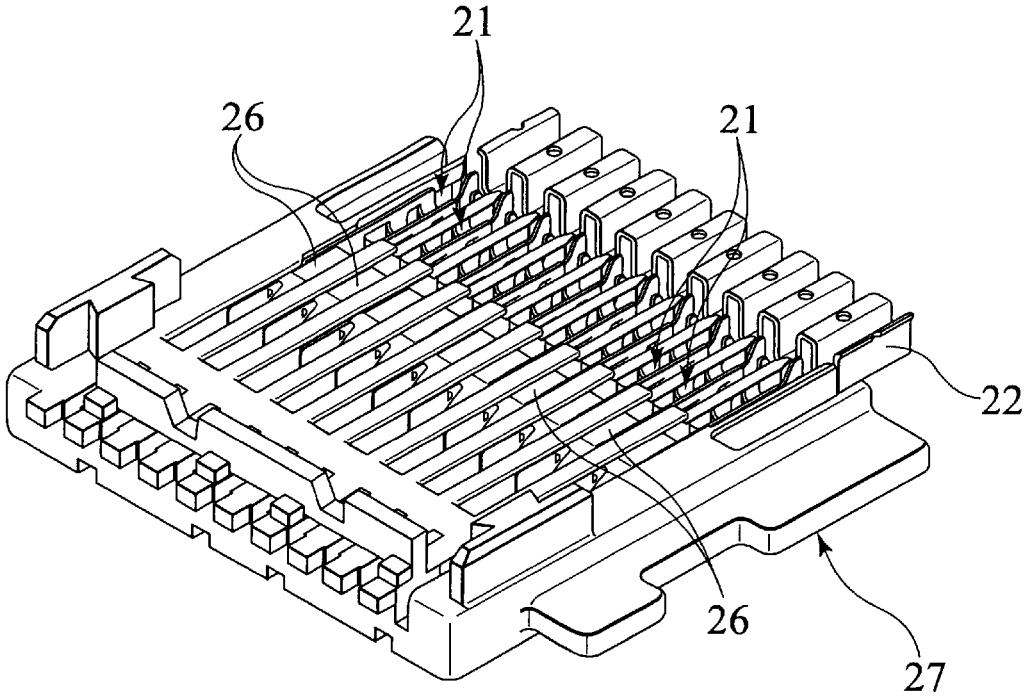
FIG. 3 is a perspective view showing the assembly step in the embodiment.

Then, as shown in FIG. 2, the terminal group body 23 is provisionally accommodated in the connector housing 27 (an assembly step). In this step, only the carrier 22 of the terminal group body 23 is not accommodated in the connector housing 27. As shown in FIG. 2, the connector housing 27 is formed with accommodation groove parts 28 for respectively accommodating the terminals 21 and respective adjacent groove parts 28 are separated from each other by partitions 29. A bottom part of each the groove part 28 is formed with an opening part 27*a* for connection (shown in FIG. 11) that enables the tab 26 to be inserted into the part 21A of the terminal 21.

Figure 4:
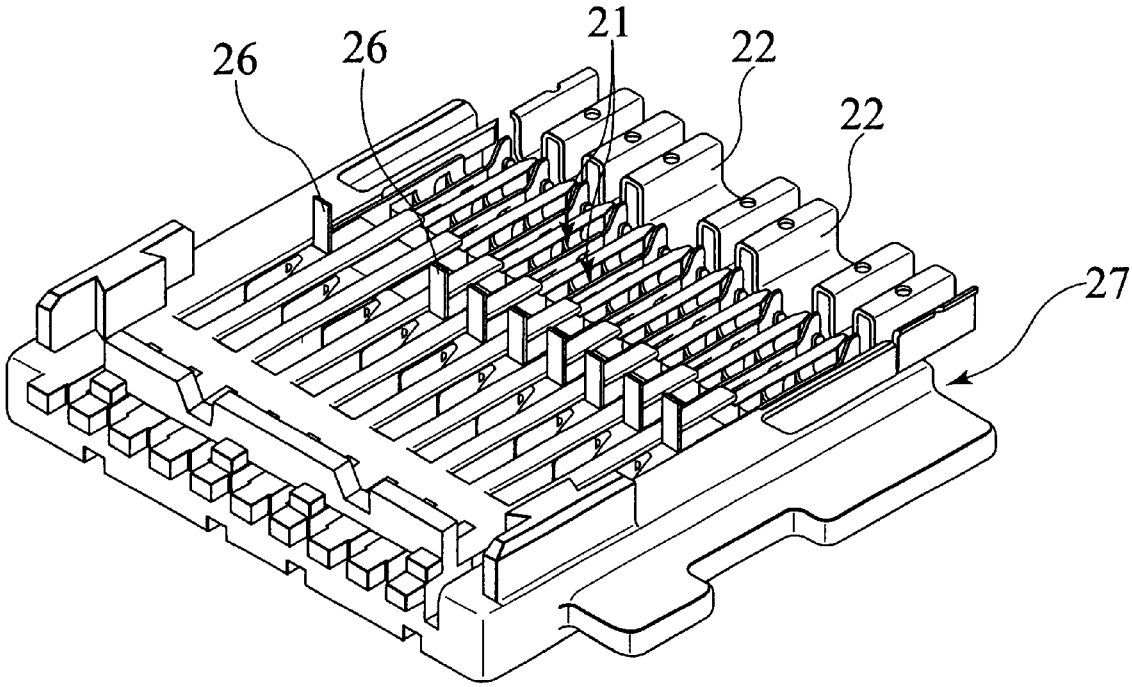
FIG. 4 is a perspective view showing a carrier cutting step and a tab raising step in the embodiment.

In this state, as shown in FIG. 4, the carrier 22 is then cut in a predetermined position according to a design of an electric circuit. The tabs 26 of predetermined terminals 21 are raised. At this time, only predetermined tabs 26 of the tabs 26 that are lying are now raised so as to form a predetermined electric circuit by a relationship between a connector 39 that will be described later and is formed of the terminals 21 accommodated in the connector housing 27 and another connector placed on or under the connector 39.

Figure 5A:
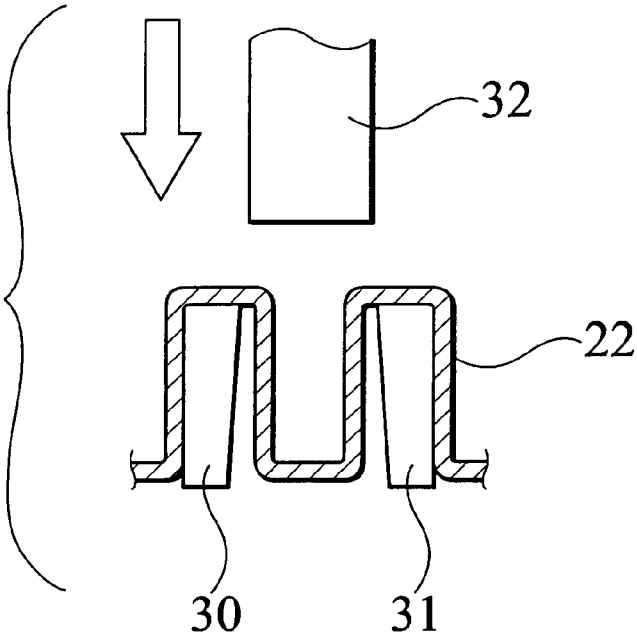
FIGS. 5A and 5B are sectional explanatory views showing a method of cutting a carrier in the embodiment.
Figure 5B:
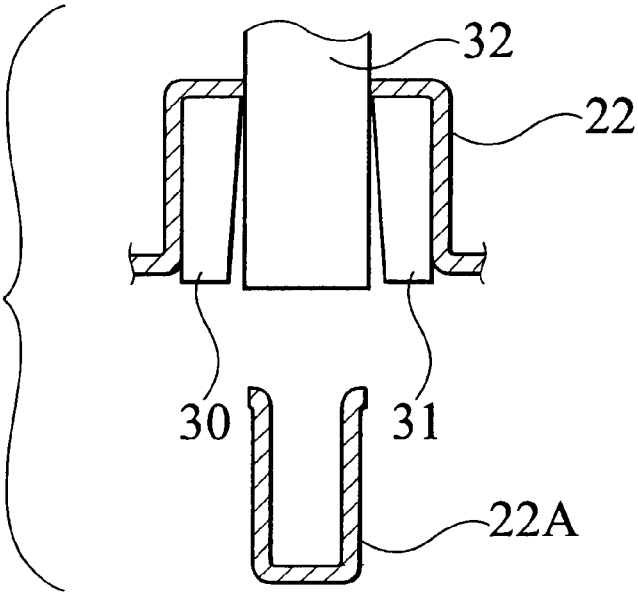

In order to cut the carrier 22, as shown in FIG. 5A, jigs 30 and 31 are placed such that a part of the carrier 22 in a predetermined position is pinched between the jigs 30 and 31 and a cutting jig 32 is moved down from above. As a result, the carriers 22 are electrically separated from each other when a cut piece 22A is removed.

Figure 6A:
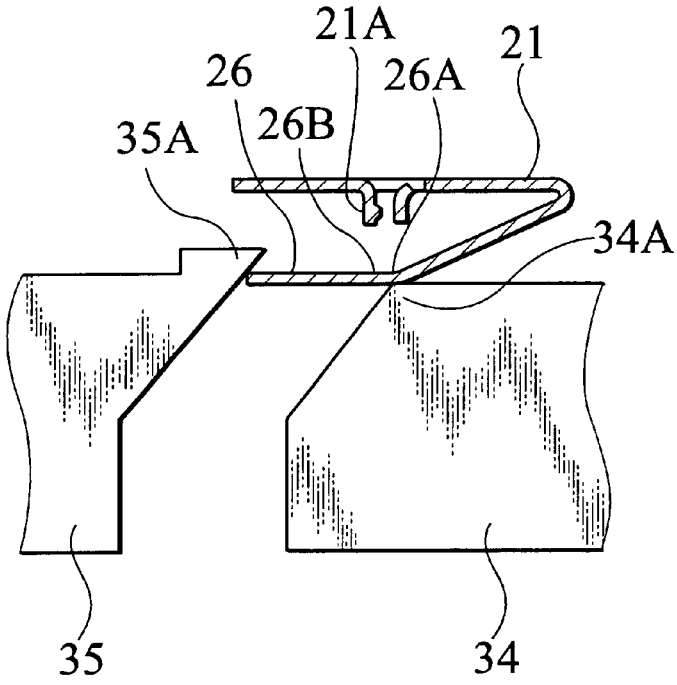
FIGS. 6A and 6B are sectional explanatory views showing a method of raising the tab in the embodiment.
Figure 6B:
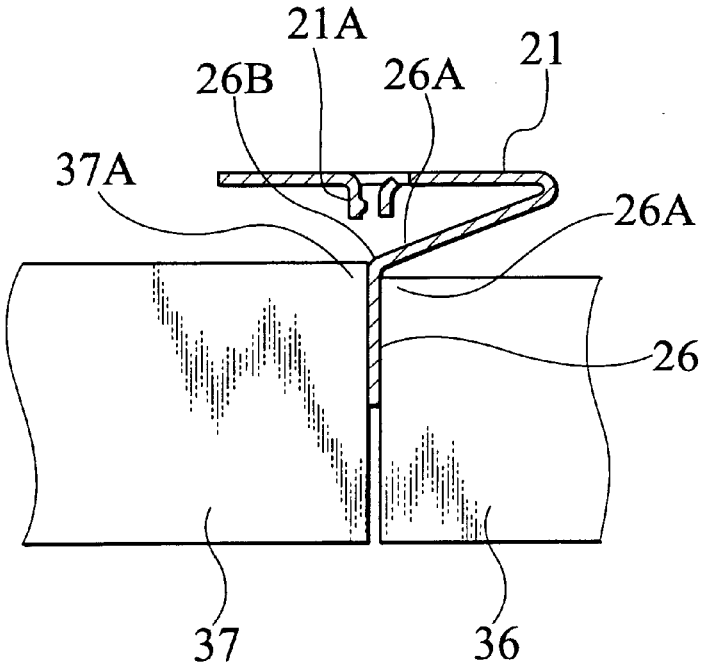

In order to raise the tab 26 of the terminal 21, as shown in FIG. 6A, a jig 34 for raising is first placed such that a corner part 34A is in contact with a position 26B to be bent that is slightly spaced toward a tab tip end from a part 26A to be bent of the tab 26. By moving a movable jig 35 for raising and having a tip end part 35A for catching the tip end of the tab 26 closer to the jig 34, the tab 26 can be bent in the position 26B. Then, the jig 34 is replaced by a jig 36 having a right-angled corner part 36A, a movable jig 37 for raising and similarly having a right-angled corner part 37A is used, and the tab 26 is pushed against the jig 36, thereby raising the tab 26 vertically.

Figure 7:
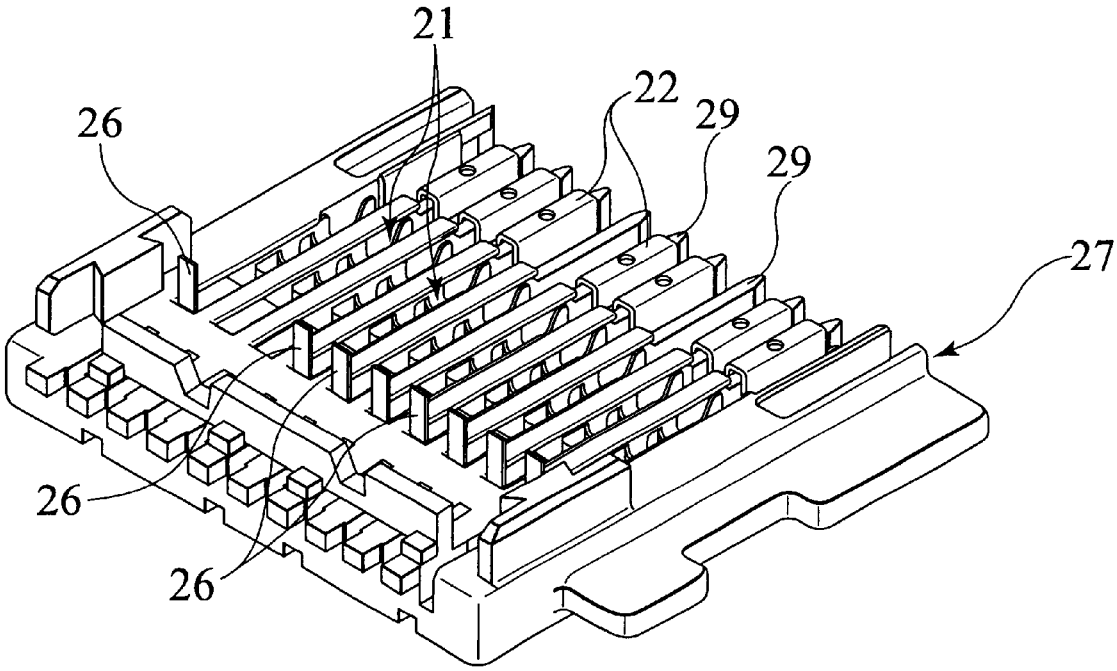
FIG. 7 is a perspective view showing the assembly step in the embodiment.
Figure 8:
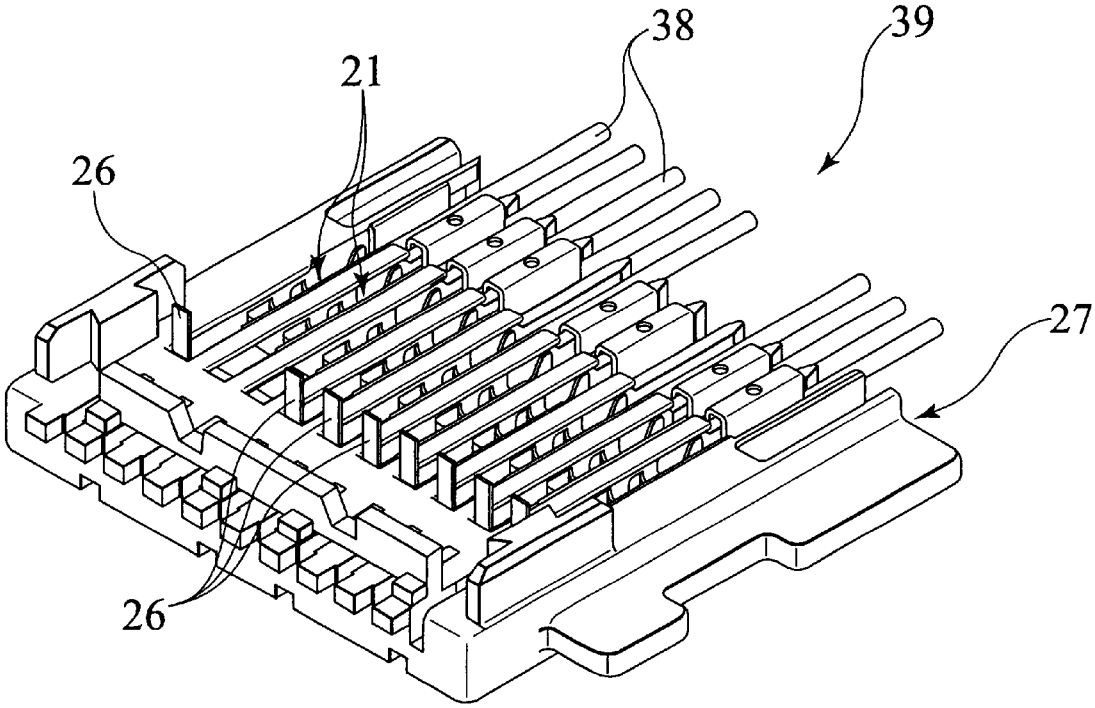
FIG. 8 is a perspective view showing a connector in the embodiment.

Then, as shown in FIG. 7, the entire terminal 21 including the carrier 22 is accommodated in the connector housing 27. At this time, the carrier 22 that has not been cut is accommodated to cross over the partitions 29 of the connector housing 27. Then, as shown in FIG. 8, wire harnesses 38 are respectively mounted to the respective terminals 21. In order to mount the wire harness 38 to each the terminal 21, the wire harness 38 is press-fitted between insulation displacement blades formed on inner side faces facing each other of the side plates 24 and 25 to establish connection between the blades and a core as is well known. Thus, the terminals 21 are accommodated in the connector housing 27 and the connector 39 in which the wire harnesses 38 are connected to the terminals 21 is completed.

Figure 9:
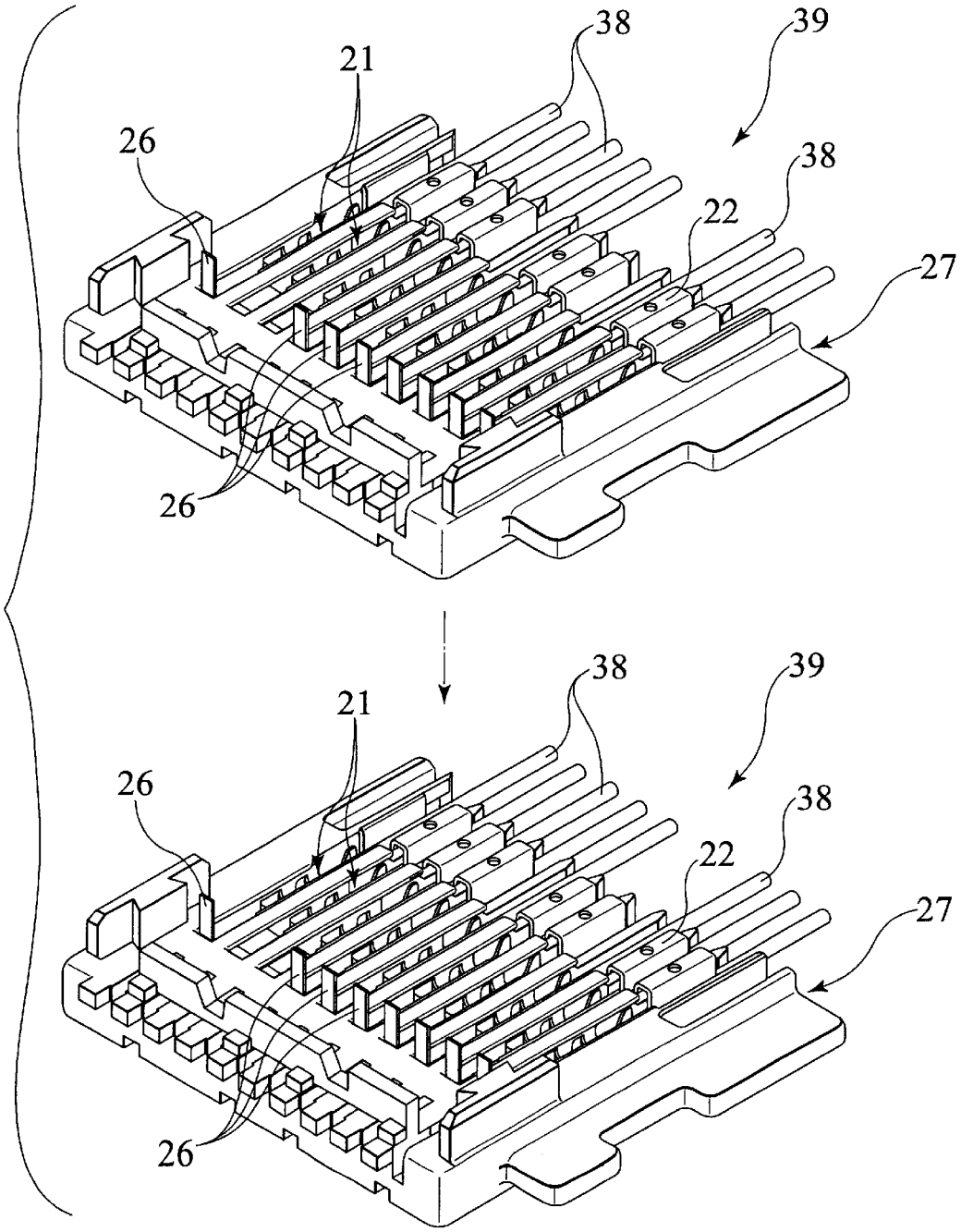
FIG. 9 is a perspective view showing a connector connecting step in the embodiment.
Figure 10:
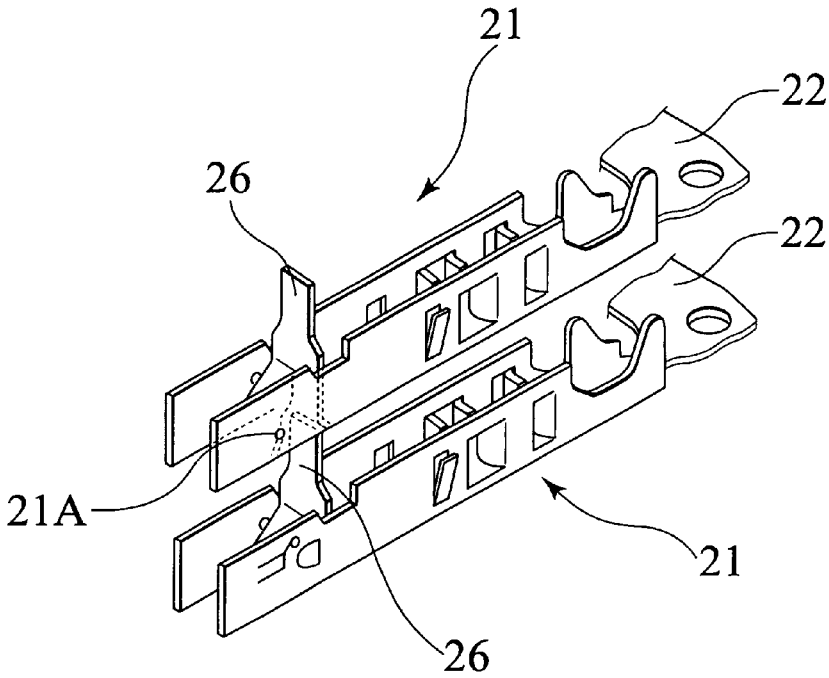
FIG. 10 is a perspective view showing a connected state of the terminals in the embodiment.

Then, by stacking the connectors 39 vertically with the predetermined tabs 26 raised as shown in FIG. 9, the raised tab 26 of the lower connector 39 is inserted into the opening part 27*a* formed on a lower face of the upper connector 39 and is connected to a part 21A of each the terminal 21 as shown in FIG. 10.

In such an embodiment, when the terminal group body 23 is transferred, tabs 26 are not deformed even if the terminal group body 23 is wound around a reel, for example, because the tabs 26 are lying. Since the tab 26 is bent in the position 26B that is different from the bent part 26A of the tab 26 in the step of raising the tab 26, generation of a crack or the like at a base part of the tab 26 can be prevented and strength of the tab 26 can be increased. Furthermore, in the embodiment, since the tabs 26 are raised in a state in which the tabs 26 are accommodated in the connector housing 27, an interval between the step of raising the tabs 26 and the step of stacking the connectors 39 can be shortened and a possibility of deformation of the tabs 26 can be reduced.

Figure 11:
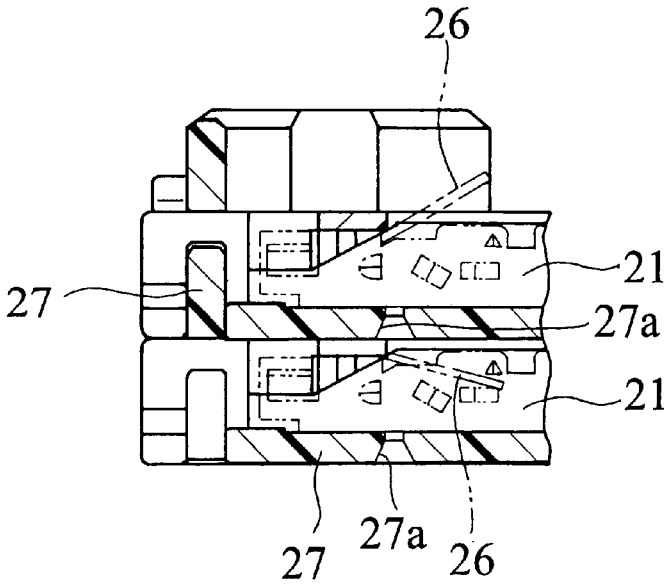
FIG. 11 is a sectional explanatory view showing connectors stacked each other.

The tab 26 lying down of the lower terminal 21, as shown in FIG. 11, is away from the part 21A to be connected of the upper terminal 21, so that upper and lower terminals 21 are not connected each other in the portion.

Although the embodiment has been described above, the present invention is not limited to the embodiment and various modifications accompanying summary of the structure may be made. For example, although the terminal 21 is employed as a terminal for connection in the above embodiment, it is of course possible to apply the invention to a terminal for connection having another structure including a raised tab 26.

What is claimed is:

1. A method of connecting a first connector and a second connector, comprising the steps of:

providing a first terminal having a first connection member;

accommodating the first terminal in a connector housing of the first connector so that the first connection member does not protrude from the connector housing of the first connector;

while accommodating the first terminal in the connector housing of the first connector, raising the first connection member so that the first connection member protrudes from the connector housing of the first connector; and stacking the first connector and the second connector to connect the raised first connection member with a second terminal of the second connector.

2. The method according to claim 1, wherein, before the raising step, the first connection member is disposed in the first terminal at substantially a right angle to a stacking direction of the first connector and the second connector.

3. The method according to claim 1, wherein the first terminal comprises side plates extending from a bottom plate and opposing each other, the first connection member extends upward from the bottom plate, and the first connection member is bent at a first position to form a portion extending parallel with the bottom plate before the raising step.

4. The method according to claim 3, wherein the raising step comprises the step of bending the first connection member at a second position different from the first position so that the portion extending parallel with the bottom plate extends away from the bottom plate.

5. The method according to claim 1, wherein the second connector accommodating the second terminal includes an opening and the second terminal includes a part aligned with the opening of the second connector so that the raised first connection member is inserted through the opening of the second connector to connect with the part of the second terminal when the first and second connectors are stacked.

6. A method of connecting first and second connectors, the method comprising the steps of:

providing a plurality of first terminals, each first terminal having a tab;

providing a plurality of second terminals;

accommodating the first terminals in the first connector so that the tabs do not protrude from the first connector;

accommodating the second terminals in the second connector;

while accommodating the first terminals in the first connector, raising the tabs of predetermined first terminals so that the tabs of the predetermined first terminals protrude from the first connector; and stacking the first and second connectors to connect the raised tabs with corresponding second terminals of the second connector.

7. The method according to claim 6, wherein, before the raising step, each tab is disposed in a corresponding first terminal at substantially a right angle to stacking direction of the first and second connectors.

8. The method according to claim 6, wherein each first terminal comprises side plates extending from a bottom plate and opposing each other, each tab extends upward from the bottom plate, and each tab is bent at a first position to form a portion extending parallel with the bottom plate before the raising step.

9. The method according to claim 8, wherein the raising step comprises the step of bending each tab of the predetermined first terminals at a second position different from the first position so that the portion extending parallel with the bottom plate extends away from the bottom plate.

10. The method according to claim 6, wherein the second connector includes a plurality of openings and each second terminal includes a part aligned with a corresponding opening of the second connector so that the raised tabs are inserted through the openings of the second connector to connect with the parts of the corresponding second terminals when the first and second connectors are stacked.

* * * * *